US008988179B2

(12) United States Patent
Kim et al.

(10) Patent No.: US 8,988,179 B2
(45) Date of Patent: Mar. 24, 2015

(54) TRANSFORMER

(71) Applicant: LG Innotek Co., Ltd., Seoul (KR)

(72) Inventors: Dong Hee Kim, Seoul (KR); Jong Jun Park, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/624,502

(22) Filed: Sep. 21, 2012

(65) Prior Publication Data

US 2013/0069751 A1 Mar. 21, 2013

(30) Foreign Application Priority Data

Sep. 21, 2011 (KR) ..... 10-2011-0095312

(51) Int. Cl.

| | |
|---|---|
| ***H01F 27/02*** | (2006.01) |
| ***H01F 17/04*** | (2006.01) |
| ***H01F 27/28*** | (2006.01) |
| ***H01F 17/06*** | (2006.01) |
| ***H01F 27/24*** | (2006.01) |
| ***H01F 27/29*** | (2006.01) |
| ***H01F 30/06*** | (2006.01) |

(52) U.S. Cl.

CPC ..... *H01F 27/2804* (2013.01); *H01F 27/29* (2013.01); *H01F 30/06* (2013.01); *H01F 2027/2819* (2013.01)

USPC ..... 336/192; 178/221; 178/232; 178/212

(58) Field of Classification Search

USPC ..... 336/178, 221, 192, 196, 182, 212, 232

See application file for complete search history.

(56) References Cited

U.S. PATENT DOCUMENTS

| | | | | | |
|---|---|---|---|---|---|
| 3,659,191 | A * | 4/1972 | Spreadbury | 323/248 |
| 4,885,445 | A * | 12/1989 | Taniguchi | 219/760 |
| 5,010,314 | A * | 4/1991 | Estrov | 336/198 |
| 5,559,487 | A * | 9/1996 | Butcher et al. | 336/178 |
| 5,684,445 | A * | 11/1997 | Kobayashi et al. | 336/83 |
| 5,886,610 | A * | 3/1999 | Canova | 336/83 |
| 6,211,767 | B1 * | 4/2001 | Jitaru | 336/200 |
| 6,636,140 | B2 * | 10/2003 | Fujiyoshi et al. | 336/200 |
| 7,248,138 | B2 * | 7/2007 | Chiang et al. | 336/200 |
| 8,212,644 | B2 * | 7/2012 | Young et al. | 336/200 |
| 2004/0032313 | A1 * | 2/2004 | Ferencz et al. | 336/200 |
| 2004/0085173 | A1 | 5/2004 | Decristofaro et al. | |
| 2011/0241816 | A1 * | 10/2011 | Park et al. | 336/200 |

FOREIGN PATENT DOCUMENTS

| | | | |
|---|---|---|---|
| JP | 07-095492 | A | 4/1995 |
| JP | 7-0115024 | A | 5/1995 |
| KR | 10-2005-0084640 | A | 8/2005 |
| KR | 20-0231598 | Y1 | 7/2010 |

* cited by examiner

*Primary Examiner* — Mangtin Lian

(74) *Attorney, Agent, or Firm* — Birch, Stewart, Kolasch & Birch, LLP

(57) ABSTRACT

A transformer includes a core inducing a magnetic field and including an upper core and a lower core; a first insulating part in an inner side of the core; a secondary winding part in an upper portion of the insulating part, a part of the secondary winding part being exposed out of the core; a second insulating part in an upper portion of the secondary winding part to insulate the second winding part; a primary winding part in an upper portion of the second insulating part; and a film between the upper core and the lower core.

11 Claims, 7 Drawing Sheets

TRANSFORMER

BACKGROUND

The embodiment relates to a transformer and a method of manufacturing the same.

In recent years, a power supply device using a switching mode power supply (SMPS) is attracting attention. The SMPS stably provides power using a switching device, such as a metal oxide semiconductor field effect transistor (MOS FET) or a bipolar junction transistor (BJT), and a transformer.

Meanwhile, as household appliances have tended toward the light and slim structure with a small size, there is a need to implement the SMPS having the slim structure. In this regard, research has been continuously performed to reduce a volume of a transformer having a large volume among circuit components constituting the SMPS.

SUMMARY

According to a transformer and a method of manufacturing the same of an embodiment, the transformer can be manufactured in a slim structure so that a power supply device including the transformer may have a slim structure.

Further, according to a transformer and a method of manufacturing the same of an embodiment, a manufacturing cost of the transformer can be reduced and the efficiency of the transformer can be improved.

According to the embodiment, there is provided a transformer including a core inducing a magnetic field and including an upper core and a lower core; a first insulating part in an inner side of the core; a secondary winding part in an upper portion of the insulating part, a part of the secondary winding part being exposed out of the core; a second insulating part in an upper portion of the secondary winding part to insulate the second winding part; a primary winding part in an upper portion of the second insulating part; and a film between the upper core and the lower core.

According to the transformer and the method of manufacturing the same of an embodiment, the transformer can be manufactured in a slim structure so that a power supply device including the transformer may have a slim structure.

Further, according to the transformer and the method of manufacturing the same of an embodiment, a manufacturing cost of the transformer can be reduced and the efficiency of the transformer can be improved.

DETAILED DESCRIPTION OF THE EMBODIMENTS

Figure 1:
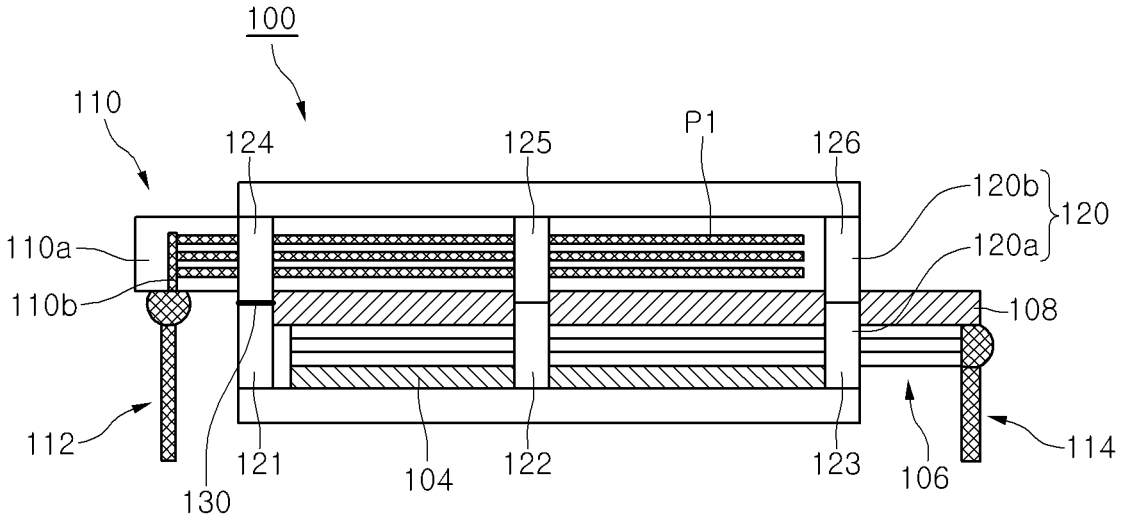
FIG. 1 is a side view illustrating a transformer according to an embodiment.

Hereinafter, an exemplary embodiment of the disclosure will be described with reference to accompanying drawings. The details of other embodiments are contained in the following detailed description and accompanying drawings. The advantages and features of the disclosure, and the method of accomplishing the advantages and features of the disclosure will be apparent through the following description together with accompanying drawings. The same reference numerals will be assigned to the same elements.

Figure 2:
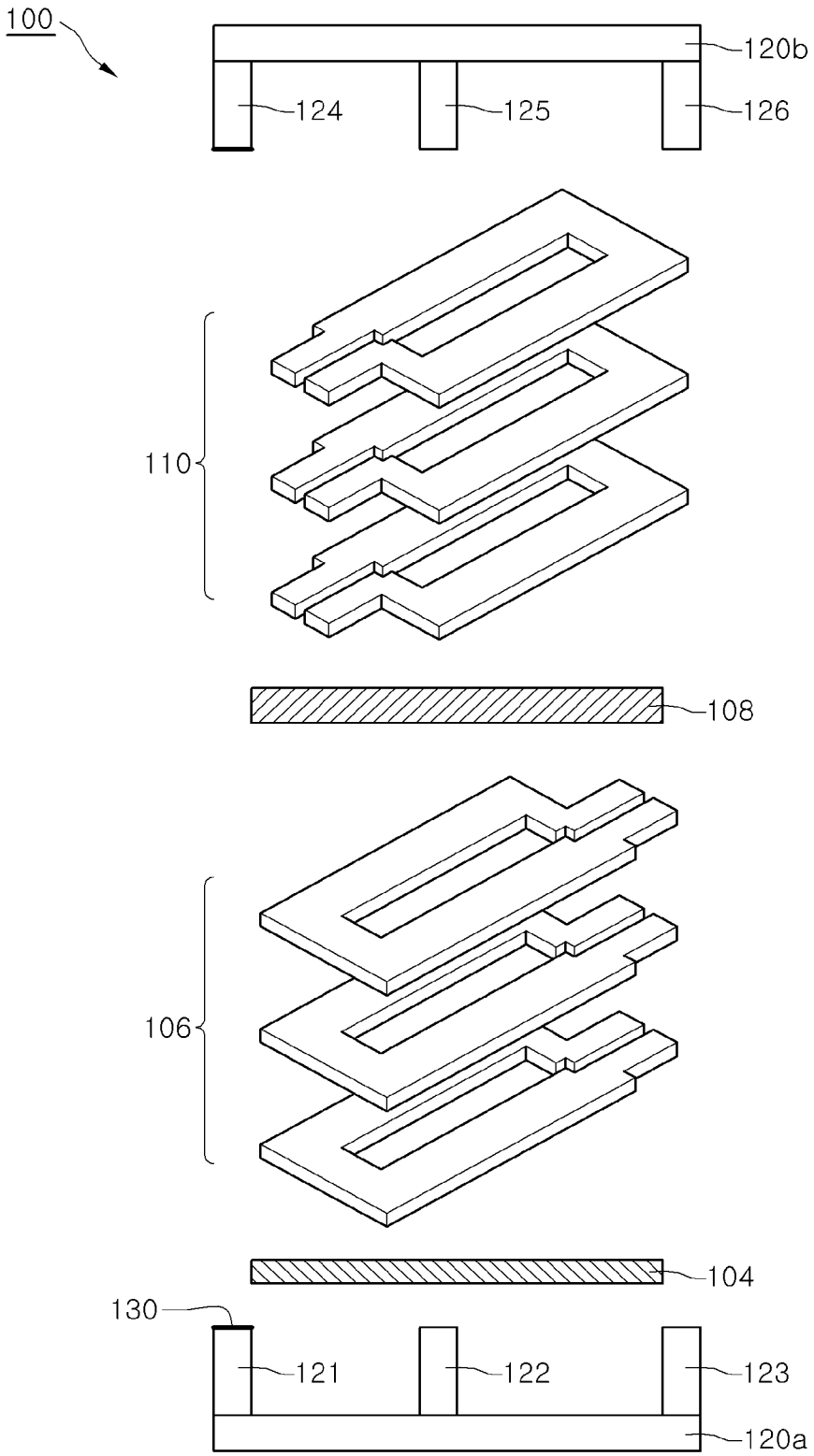
FIG. 2 is an exploded view illustrating an exploded transformer according to an embodiment.

FIG. 1 is a side view illustrating a transformer according to an embodiment, and FIG. 2 is an exploded view illustrating an exploded transformer according to an embodiment.

Referring to FIGS. 1 and 2, the transformer 100 according to the embodiment includes a core 120, a first insulating part 104, a secondary winding part 106, a second insulating part 108, a primary winding part 110, a power signal supply part 112, and a power signal output part 114.

The core 120 is provided to induce the magnetic field. The first insulating part 104 is provided in an inner side of the core to insulate the secondary winding part 106.

In this case, the core 120 may include a lower core 120*a* and an upper core 120*b*, and the first insulating part 104 may be provided as an insulating sheet.

The core 120 includes the lower core 120*a* and the upper core 120*b*. The lower core 120*a* and the upper core 120*b* may have an "E" shape. In detail, the lower core 120*a* includes a central part 122, a first side part 121, and a second side part 123. An end of the first side part 121, an end of the second side part 123, and an end of the central part 122 are connected with each other. An opposite side of the first side part 121, an opposite side of the second side part 123, and an opposite side of the central part 122 are separated from each other. The first and second side parts 121 and 123 are disposed in both ends of the lower core 120*a*, respectively. The central part 122 is spaced apart from the first and second side parts 121 and 123 and is disposed in the center of the first and second side parts 121 and 123. A thickness of the central part 122 may be thinner than a thickness of each of the first and second side parts 121 and 123. However, the embodiment is not limited thereto. A structure of the upper core 120*b* has a structure having first and second side parts 124 and 126 and a central part 125, and the upper core 120*b* has the same shape as the shape of the lower core 120*a*, so a detailed description of the upper core 120*b* will be omitted.

The upper core 120*b* may be coupled with the lower core 120*a* in correspondence with the lower core 120*a*. That is, the upper core 120*b* may be coupled with the lower core 120*a* while facing the lower core 120*a*.

In general, in the transformer, a ratio of magnetizing inductance of the primary side measured in an open state of the secondary side of the transformer to leakage inductance measured in a short state of the transformer is ideally set to 7:1 to 5:1, and the transformer having a ratio of 5:1 has been produced because of productivity. To this end, gaps are respectively formed in the central part 122 of the lower core 120*a* and in the central part 125 of the upper core 120*b* and silicon is bonded in the gaps. However, due to the silicon, a volume of the core 120 in the transformer is increased and a winding thickness becomes larger, so that a manufacturing cost is increased. In addition, since the volume of the core 120 is increased, a PCB area is enlarged.

For this reason, for example, a film 130 is formed between the first side part 121 of the lower core 120*a* and the first side part 124 of the upper core 120*b* to determine a ratio of magnetizing inductance to leakage inductance as a ratio approximate to 7:1.

The film 130 may include an insulating material, for example, a plastic material such as polyester. However, the embodiment is not limited thereto.

The film 130 may have a thickness corresponding to a volume of the core 120. For example, when a transverse length of the core 120 is 38 mm, and a longitudinal length of the core 120 including the first and second side parts 121 and

123 and the central part 122 is 35 mm, the film 130 may have a thickness of 0.05 to 0.06 mm.

The film 130 may be formed on at least one of the first and second side parts 121 and 123 or the central part 122. When a plurality of films 130 are formed on the first and second side parts 121 and 123 or the central part 122, the films 130 may be increased or reduced in thickness.

When the film 130 is formed on at least one of the first and second side parts 121 and 123 or the central part 122, only the film 130 is inserted without polishing a core of a formed port, so that productivity can be improved.

Because the ratio of the magnetizing inductance to the leakage inductance may be set approximately to 7:1 due to the film 130, an electric current flowing through the primary side and the secondary side is reduced so that a thickness of a coil and heat loss are reduced.

The secondary winding part 106 is provided in an upper portion of the first insulating part 140 and a part of which is exposed out of the lower core 120*a* of the core 120.

The secondary winding part 106 may be provided in the form of a metallic pattern layer having inductance.

The metallic pattern layer may be formed by a metallic material having high conductivity to efficiently and easily output a transformed power signal.

The second insulating part 108 is provided in an upper portion of the secondary winding part 106 a part of which is exposed out of the lower core 120*a* of the cores 120, thereby insulating the secondary winding part 106.

The second insulating part 108 may be provided as an insulating sheet.

The primary winding part 110 is provided in an upper portion of the second insulating part 108 to be insulated from the second insulating part 108 a part of which is exposed out of the upper core 120*b* of the cores 120.

The primary winding part 110 exposed out of the upper core 120*b* of the cores 120 and the secondary winding part 106 exposed out of the lower core 120*a* of the core 120 may be provided in different directions.

The primary winding part 110 may be provided as a printed circuit board 110*a* including a metal pattern P1 having inductance.

The metal pattern P1 having the inductance is provided by a metallic material having high conductivity to efficiently and easily supply a power signal from a power signal supply part 112 to be described below.

The power signal supply part 112 is electrically connected to the primary winding part 110 exposed out of the upper core 120*b* of the core 120 and supplies a power signal.

The power signal supply part 112 may be electrically connected to an end of the primary winding part 110 exposed out of the upper core 120*b* of the core 120.

The power signal supply part 112 may be provided by a metallic material having high conductivity to efficiently and easily supply a power signal to the primary winding part 110.

In this case, the power signal supply part 112 may be provided as a terminal to be coupled with a first via hole 110*b* formed in the printed circuit board 110*a*.

A power signal output part 114 may be electrically connected to the secondary winding part 106 exposed out of the lower core 120*a* of the core 120 to output a power signal transformed by the secondary winding part 106.

In this case, the power signal output part 114 may be electrically connected to an end of the secondary winding part 106 exposed out of the lower core 120*a* of the core 120.

The power signal output part 114 may be made from a metallic material having high conductivity to efficiently and easily output a power signal transformed by the secondary winding part 106.

In this case, the power signal output part 114 may be provided as a terminal to be locked in a second via hole 108*a* formed in the second insulating part 108.

Hereinafter, a method of sequentially manufacturing the transformer 100 according to the embodiment will be described with reference to FIGS. 3 to 11.

Figure 3:
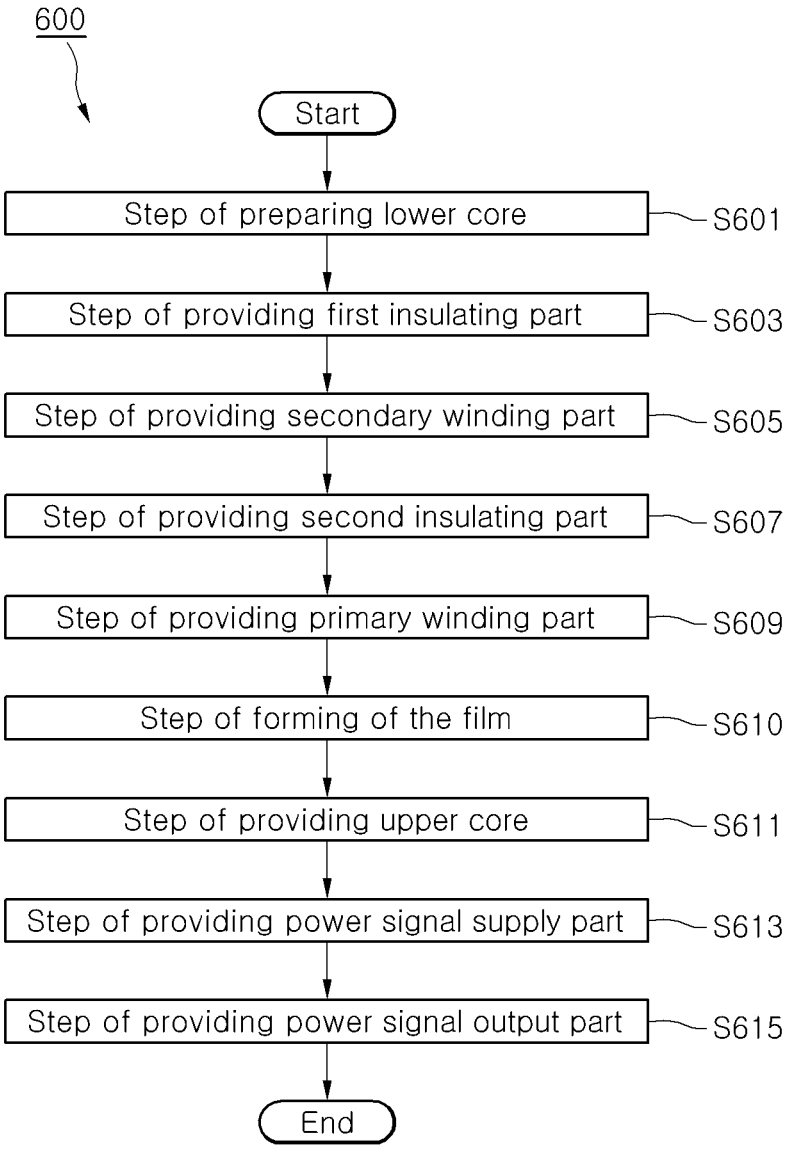
FIG. 3 is a flowchart sequentially illustrating a method of manufacturing a transformer according to an embodiment.

FIG. 3 is a flowchart sequentially illustrating a method of manufacturing a transformer according to an embodiment, and FIGS. 4 to 11 are views sequentially illustrating a method of manufacturing a transformer according to an embodiment.

Referring to FIG. 3, the method 600 of manufacturing the transformer includes the steps of: preparing a lower core (S601), providing a first insulating part (S603), providing a secondary winding part (S605), providing a second insulating part (S607), providing a primary winding part (S609), providing an upper core (S611), providing a power signal supply part (S613), and providing a power signal output part (S615).

Figure 4:
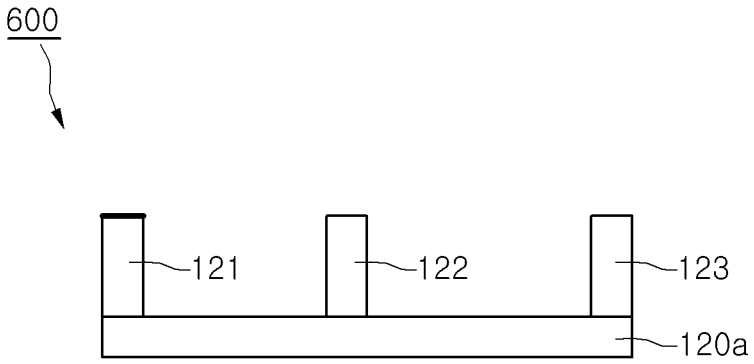
FIGS. 4 to 11 are views sequentially illustrating a method of manufacturing a transformer according to an embodiment.
Figure 5:
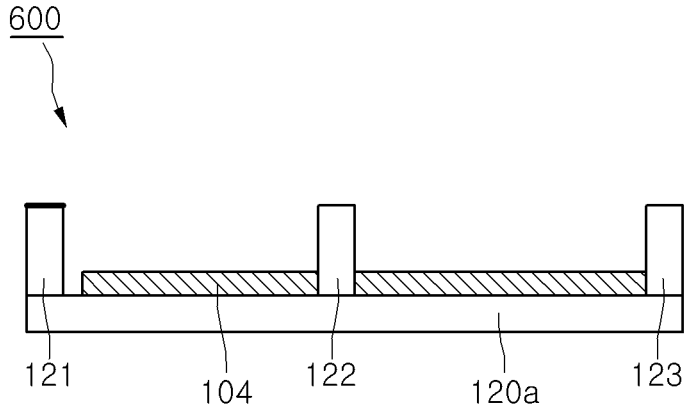

First, in the preparing of the lower core (S601), the lower core 120*a* is prepared to induce a magnetic field as illustrated in FIG. 4. In the providing of the first insulating part (S603), the first insulating part 104 is provided in an inner side of the lower core 120*a* as illustrated in FIG. 5.

In this case, the providing of the first insulating part (S603) may be a step of providing the first insulating part 104 in the form of an insulating sheet.

Figure 6:
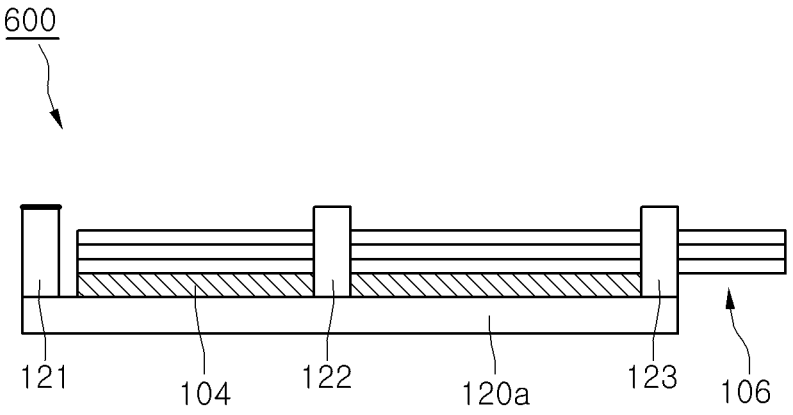

After that, in the providing of the secondary winding part (S605), the secondary winding part 106 is provided in an upper portion of the first insulating part 104, a part of which is exposed out of the lower core 120*a* as illustrated in FIG. 6.

The providing of the secondary winding part (S605) may include a step of providing the secondary winding part 106 in the form of a metal pattern layer having inductance.

In this case, the providing of the secondary winding part (S605) may include a step of forming the metal pattern layer having the inductance through at least one of a photo-lithography process using a photo mask and etching solution or an injection molding process using a compression press.

The providing of the secondary winding part (S605) may include a step of efficiently and easily outputting a transformed power signal by forming a metal pattern layer 106*a* having inductance using a metallic material having conductivity.

Figure 7:
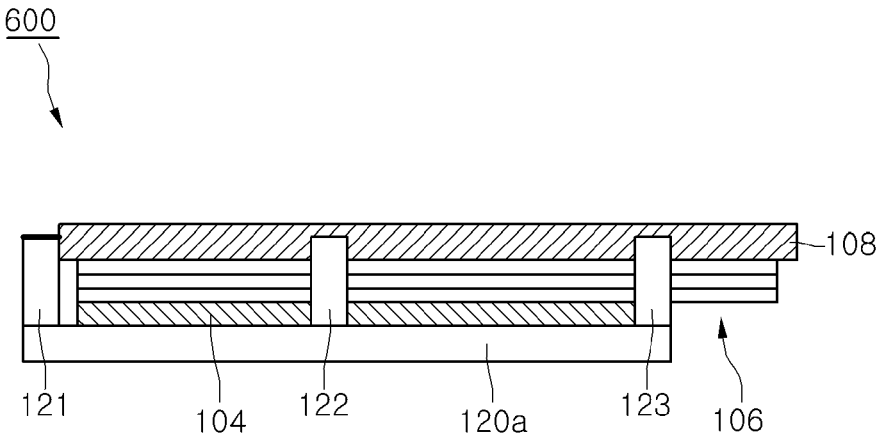

After that, as shown in FIG. 7, in the providing of the second insulating part (S607), the second insulating part is provided in an upper portion of the secondary winding part 106 to insulate the secondary winding part 106 by providing the second insulating part 108 in an upper portion of the secondary winding part 106 such that an end of the second insulating part is exposed out of the lower core 102*a*.

The providing of the second insulating part (S607) may include a step of providing the second insulating part 108 by an insulating sheet.

Figure 8:
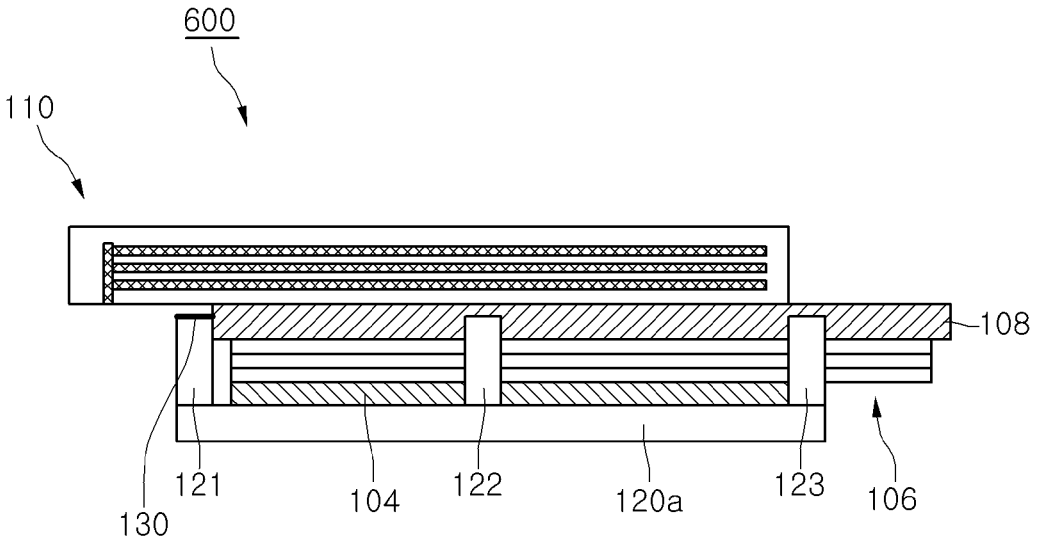

After that, as illustrated in FIG. 8, in the providing of the primary winding part (S609), the primary winding part 110 is provided in an upper portion of the second insulating part 108 to insulate the second insulating part 108 such that a part of the primary winding part 110 is exposed out of the lower core 120*a*.

In this case, the providing of the primary winding part (S609) may include a step of providing the primary winding part 110 exposed out of the upper core 120*b* and the secondary winding part 106 exposed out of the lower core 120*a* in different directions.

After that, the forming of the film 130 (S610) is performed. The film 130 may be formed in the first side part 121 of the lower core 120*a*.

Figure 9:
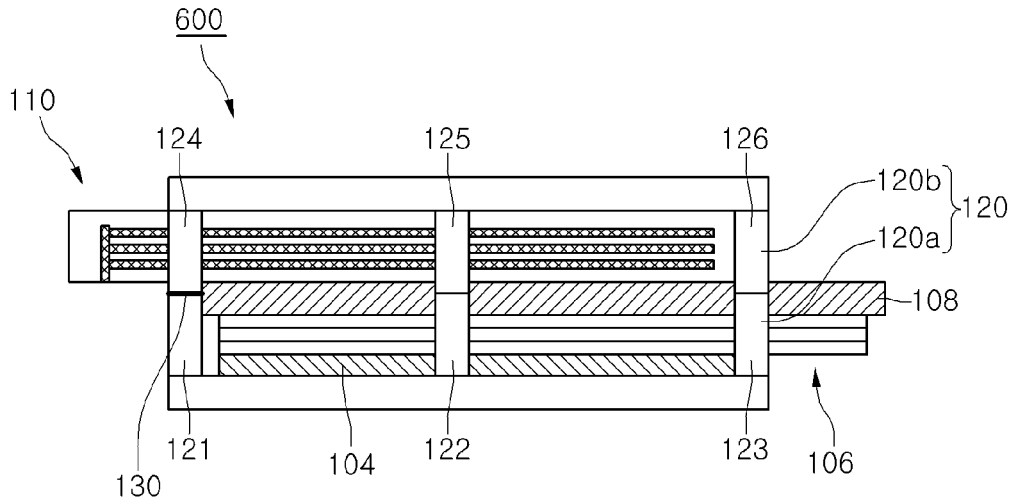

After that, as shown in FIG. 9, in the providing of the upper core (S611), the upper core 120*b* is provided to fix the primary winding part 110 such that the upper core 120*b* can be coupled with the lower core 120*a*.

Figure 10:
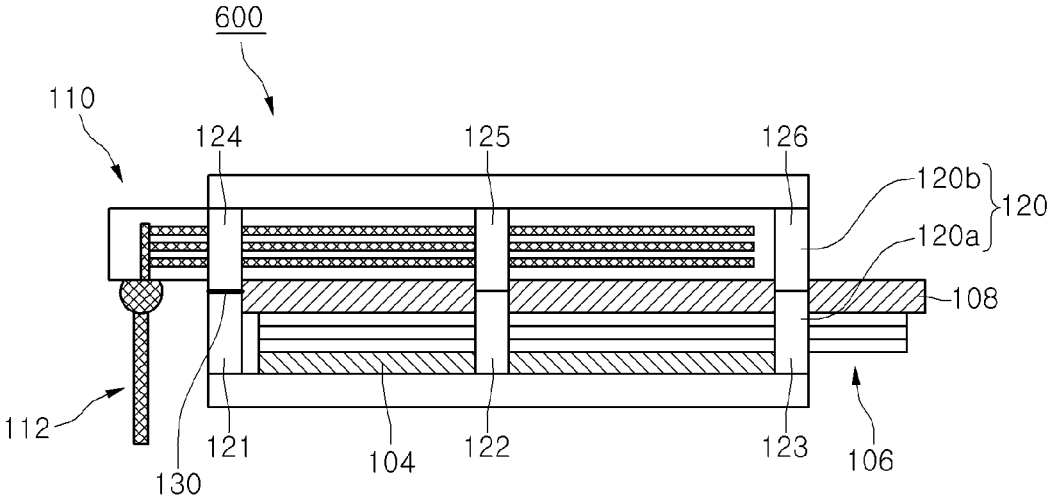

After that, as shown in FIG. 10, in the providing a power signal supply part (S613), the power signal supply part 112 is provided such that the power signal supply part 112 can be electrically connected to the first primary winding part 110 exposed out of the lower core 120*b*, thereby supplying a power signal.

In this case, the providing a power signal supply part (S613) may include a step of electrically connecting the power signal supply part 112 to an end of the primary winding part 110 exposed out of the upper core 120*b*.

The providing of the power signal supply part (S613) may include a step of efficiently and easily supplying a power signal to the primary winding part 110 by providing the power signal supply part 112 using a metallic material having high conductivity.

In this case, the providing a power signal supply part (S613) may include a step of providing the power signal supply part 112 as a terminal to be coupled with a first via hole 110*b* formed in the printed circuit board 110*a*.

Figure 11:
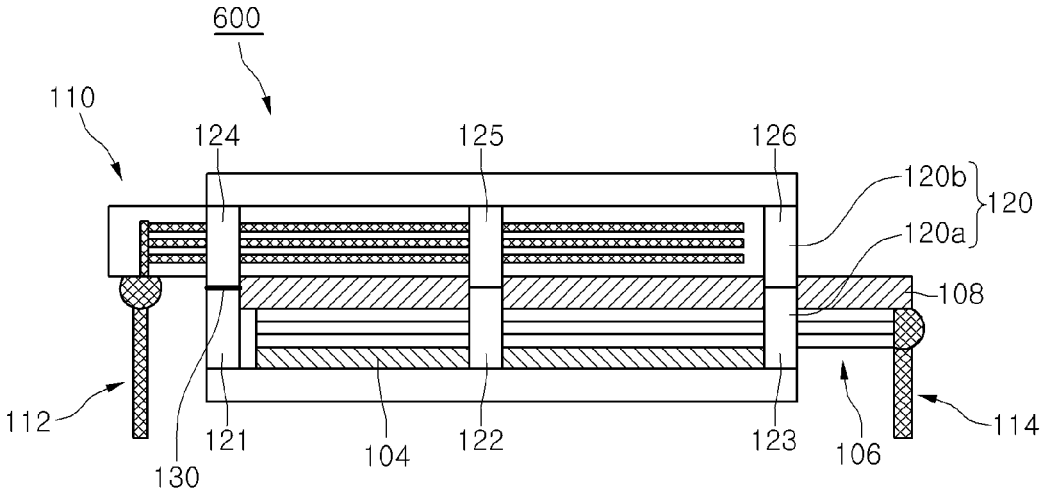

Finally, as illustrated in FIG. 11, in the providing of the power signal output part (S615), the power signal output part 114 is provided such that the power signal output part 114 can be electrically connected to the secondary winding part 106 exposed out of the lower core 120*a* to output a power signal transformed by the secondary winding part 106.

In this case, the providing of the power signal output part (S615) may include a step of electrically connecting the power signal output part 114 to an end of the secondary winding part 106 exposed out of the lower core 120*a*.

The providing of the power signal output part (S615) may include a step of efficiently and easily outputting a power signal transformed by the secondary winding part 106 by providing the power signal output part 114 using a metallic material having high conductivity.

In this case, the providing of the power signal output part (S615) may include a step of providing the power signal output part 114 as a terminal to be coupled with a second via hole 108*a* formed in the second insulating part 108.

In the transformer according the embodiment, when the film 130 is formed on at least one of the first and second side parts 121 and 123 or the central part 122, the film 130 may be simply inserted without polishing a portion of the core where the film 130 is formed, so that productivity can be improved and a volume of the core 120 is decreased up to 30% than before.

Since the ratio of the magnetizing inductance to the leakage inductance may be set approximately to 7:1 to 5:1 due to the film 130, an electric current flowing through the primary side and the secondary side is reduced so that a thickness of a coil and heat loss are reduced, thereby improving efficiency of the transformer.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effects such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A transformer comprising:

a core inducing a magnetic field and including an upper core and a lower core;

a first insulating part in an inner side of the core;

a secondary winding part disposed on the first insulating part and having a first end exposed out of the core and a second end within the core;

a second insulating part disposed on the secondary winding part to insulate the second winding part and having a second portion exposed out of the core;

a primary winding part disposed on the second insulating part;

a film between the upper core and the lower core, and a power signal output part electrically connected to the first end of the secondary winding part, wherein the second portion of the second insulating part has a width larger than a width of the first end of the secondary winding part, wherein the second portion of the second insulating part covers an entire top surface of the first end of the secondary winding part, wherein a side surface of the power signal output part is directly connected to a side surface of the first end of the secondary winding part, wherein a top surface of the power signal output part is directly connected to a bottom surface of the second portion of the second insulating part and covered by a top surface of the second portion of the second insulating part, wherein the upper core and the lower core each include a central part, a first side part and a second side part, wherein the film is disposed between the first side part of the upper core and the first side part of the lower core, wherein the central part of the upper core directly contacts the central part of the lower core, and the second side part of the upper core directly contacts the second side part of the lower core, and wherein a ratio of magnetizing inductance to leakage inductance is set to 7:1.

2. The transformer of claim 1, wherein the upper core and the lower core have an 'E' shape.

3. The transformer of claim 1, wherein the film comprises insulating material.

4. The transformer of claim 1, wherein the primary winding part and the secondary winding part are partially exposed out of the core in different directions.

5. The transformer of claim 1, wherein the primary winding part and the secondary winding part include a metal pattern layer having inductance.

6. The transformer of claim 4, further comprising:

a power signal supply part electrically connected to the primary winding part exposed out of the core to supply a power signal, wherein the power signal output part electrically connected to the portion of the secondary winding part exposed out of the core outputs a power signal transformed by the secondary winding part.

7. The transformer of claim 6, wherein at least one of the power signal supply part and the power signal output part comprises a metallic material.

8. The transformer of claim 1, wherein the film forms a gap between the first side of the upper core and the first side of the lower core.

9. The transformer of claim 1, wherein the film has a length of 0.05 to 0.06 mm.

10. The transformer of claim 1, wherein the portion of the second insulating part exposed out of the core extends further from the core than the portion of the secondary winding part exposed out of the core.

11. The transformer of claim 2, wherein a first end of the second insulating part is exposed out of the core, and wherein a second end of the second insulating part is opposed to the first end and disposed in the core.

* * * * *